United States Patent [19]

Comeau

[11] 4,276,920

[45] Jul. 7, 1981

[54] TRAVERSE ROD AND SUPPORT COMBINATION

[75] Inventor: Paul E. Comeau, Warwick, R.I.

[73] Assignee: Kenney Manufacturing Company, Warwick, R.I.

[21] Appl. No.: 33,161

[22] Filed: Apr. 25, 1979

Related U.S. Application Data

[63] Continuation-in-part of Ser. No. 23,071, Mar. 23, 1979, and a continuation-in-part of Ser. No. 27,466, Apr. 5, 1979.

[51] Int. Cl.[3] ..... A47H 5/032

[52] U.S. Cl. ..... 160/345; 16/87.6 R

[58] Field of Search ..... 160/123–126, 160/330, 345–348; 16/87.6 R

[56] References Cited

U.S. PATENT DOCUMENTS

| | | | |
|---|---|---|---|
| 452,282 | 5/1891 | Pfeil | 160/126 |
| 2,683,891 | 7/1954 | Rosenbaum | 160/124 |
| 3,370,819 | 2/1968 | Kenney | 160/345 |
| 3,430,678 | 3/1969 | Steck et al. | 160/346 |
| 3,951,197 | 4/1976 | Cohen et al. | 160/346 |

*Primary Examiner*—Philip C. Kannan

[57] ABSTRACT

A traverse rod having pulley cases at each end for the operation of a draw cord is supported by a plurality of suspension brackets intermediate of the rod ends. The pulley cases serve only as supports for the pulleys and not also as supports for the rod, and, therefore, they are of lighter than usual construction. The draw cord exits from one pulley case in the form of a loop in a direction horizontally rearwardly from the pulley case and passes over a pair of pulleys mounted adjacent to the supporting wall, whereby tension on the draw cord adds negligible strain to the support requirements of the brackets. Heavy and thick curtains are supported without disproportionate increase in size and/or strength of the rod and support components as compared to conventional rods.

1 Claim, 8 Drawing Figures

TRAVERSE ROD AND SUPPORT COMBINATION

FIELD OF THE INVENTION

The present invention is a continuation in part of application Ser. No. 23,071, filed Mar. 23, 1979 entitled "Curtain Supporting and Positioning Combination", and a continuation in part of application Ser. No. 27,466, filed Apr. 5, 1979 entitled "Drapery and Support Combination".

The present invention relates to drapery supports and more specifically to supporting heavy curtains and other drapery material. The invention is particularly useful in the support of thick and heavy curtains which must hang in a position offset from the supporting wall, as for instance, "woven wood" curtains in which the curtain comprises a multiplicity of hinged, vertically disposed slats adapted to open and close in accordion fashion. Such "woven wood" curtains are much heavier than ordinary curtains, and, due to their accordion action, they must also be supported considerably further away from the wall than ordinary curtains. Although the present invention is not limited in its use to such curtains, it is particularly suitable for use therewith, as well as with any heavy and thick curtain material.

BACKGROUND OF THE INVENTION

Conventional curtain rods which are adapted with pull cords to open and close a curtain are called traverse rods. Usually the curtain is supported on master and idler carriers which slide on a track defined by a slot in the rear or underneath surface of the rod. At each end of the rod is a pulley case which serves both to house pulleys for the draw cord and to support the rod by means of brackets connected between the pulley case and the adjacent supporting wall. At one end of the rod, the draw cord extends downwardly from the pulley case, where it either hangs freely or terminates at a tension pulley located near the floor. At the other end of the rod, the draw cord remains within the rod and reverses direction by passing around a pulley. When long rods are employed, they are often supported additionally by a central bracket which is secured to the wall or window frame and to the top of the rod in such a way as to permit the master and idler carriers to slide freely under the bracket.

The conventional way to increase the load-bearing capacity of such rods and brackets in order to accommodate heavier and thicker curtains, is simply to increase the size and/or the strength of the materials employed. The load-bearing demands, however, do not increase merely in direct proportion to the increase in weight and thickness of the curtain, but geometrically. Thus, the farther away from the wall, the curtain must hang, the longer is the lever arm acting on the brackets. This increases the burden on the connections of the bracket to the wall by the product of the added weight multiplied by the ratio of the increase of the lever arm, and thereby requires much larger bracket supports than would be required merely to support the extra weight the same distance from the wall. In addition, the tension of the draw cord aggravates the problem. Heavier and thicker curtains, of course, require more force to pull them opened and closed, but here again the pulley case at the end of the rod from which the draw cord exits, will be located further away from the wall for thicker curtains, and hence the lever arm of the supporting brackets against which the force of the cord acts at the end of the arm, will be increased, and disproportionately large bracket supports are required.

The result has been effectively to discourage the installation of heavy and thick curtains such as "woven wood" type curtains except in professionally designed and custom built installations. To date there has been no readily available traverse rod and support combination suitable for use in the consumer or "do it yourself" market which can also support thick and heavy curtains such as woven wood. A basic object of the present invention is to provide such a rod and support combination with a minimum of increase in size and/or strength of materials over conventional traverse rods.

BRIEF DESCRIPTION OF THE INVENTION

In a preferred embodiment of the present invention, a woven wood curtain is supported in an inverted U-shaped rod. The rod has a horizontal slot in its underneath surface which defines two tracks standing up within the rod. Master and idler carriers, actuated by a draw cord within the rod, are equipped with rollers to ride on the forward of the two tracks, while the rear portion of the master carriers is equipped with a slide shoe which slides on the rear track. The rod is supported by a series of suspension brackets, the bases of which are mounted on the wall or window frame, and the outer ends of which suspend the rod by means of a connection to the top of the rod. At each end of the rod there is a pulley case, the draw cord exits in the form of a loop from the pulley case at one end of the rod and passes from there horizontally rearwardly toward the supporting wall at which point it passes over a pair of pulleys and thence vertically downwardly to a tension pulley.

It is a feature of the invention that the suspension brackets alone support the rod. They need not be of inordinate size because there is no limit to the number that can be used. The number thereof can simply be increased in order to accommodate curtains of heavier weight. Further, since the rod is not supported at its ends by the pulley cases, the pulley cases need only be of sufficient size and strength to accommodate the functions of the pulleys and to provide a pleasing appearance for the end of the rod. In addition, since the draw cord exits from the pulley case rearwardly in a horizontal direction and turns downwardly only after it reaches a position adjacent to the wall, tension on the draw cord adds virtually nothing to the support requirements of the suspension brackets. These features cooperate in providing a rod and support combination which is capable of supporting heavy and thick curtains, typically woven wood curtains, in an inexpensive and convenient manner with a minimum of increased size and/or strength of the supporting components. They also make it possible to provide traverse rods capable of so performing, which are also small enough and sufficiently inexpensive to be suitable for sale in the consumer and "do it yourself" markets.

BRIEF DESCRIPTION OF THE DRAWINGS

An illustrative embodiment of the invention is shown in the accompanying drawings in which.

DETAILED DESCRIPTION OF THE INVENTION

Figure 5:
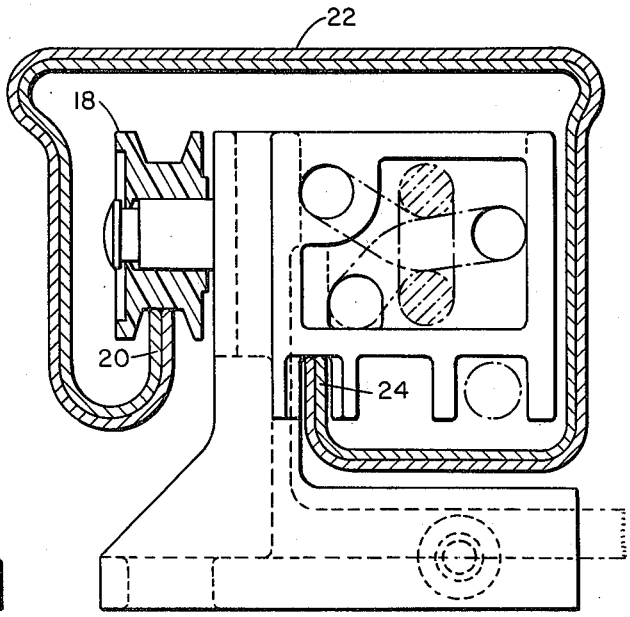
FIG. 5 is a view in end elevation from the right of the right hand master carrier of FIG. 2 shown in position within a curtain rod.
Figure 6:
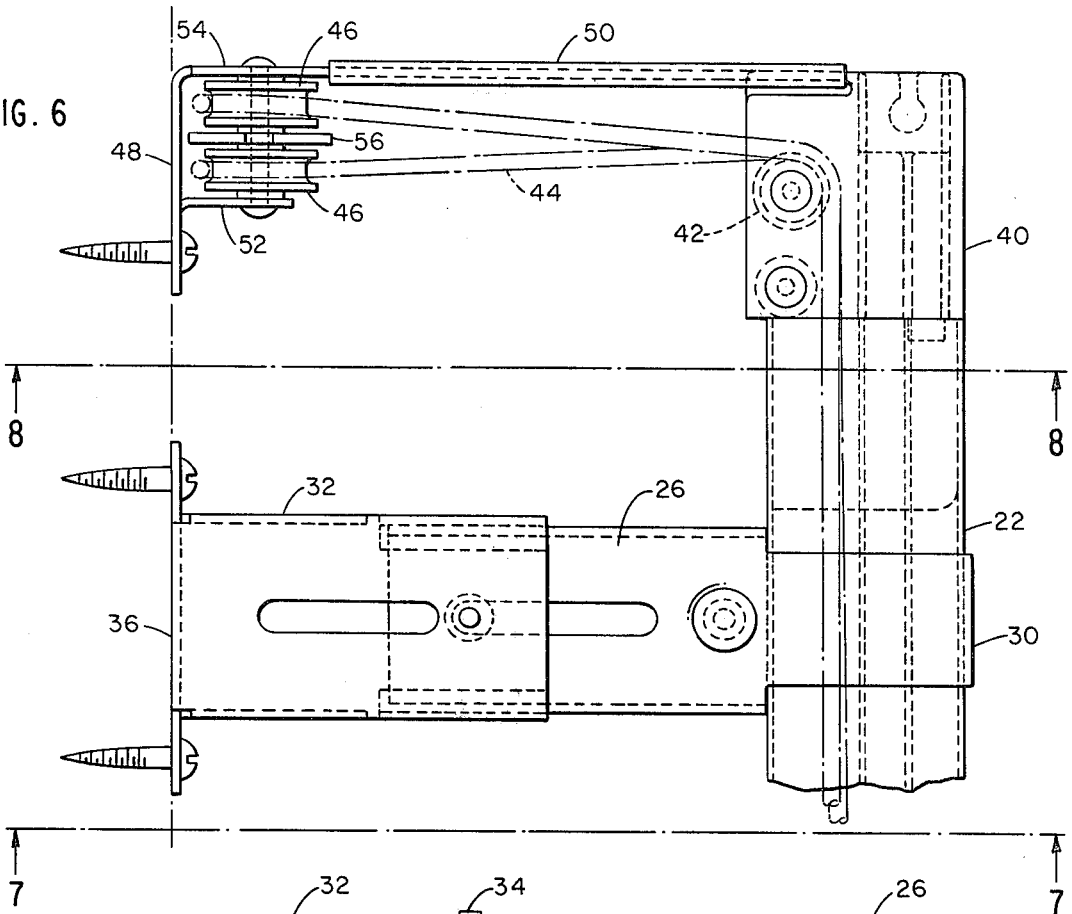
FIG. 6 is a plan view from above of the end of a traverse rod showing the pulley case and suspension bracket arrangement of the invention.
Figure 7:
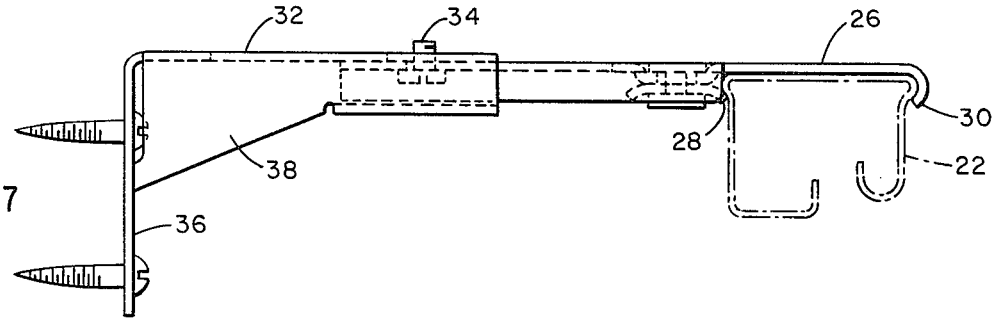
FIG. 7 is a view in side elevation of a suspension bracket.

The illustrative embodiment of the invention herein described is shown in the context of a woven wood curtain which comprises vertically disposed slats 10, mutually hinged at 12 to form an extended, accordion-like curtain. The slats 10 are pivotally supported on master carriers 14 and idler carriers 16, which are provided with rollers 18 riding on upstanding track 20 within a slotted, inverted U-shaped rod 22. The slot in rod 22 defines upstanding track 20 along its forward edge and a second track 24 along its rearward edge (see FIG. 5). Rod 22 may be of telescoping construction as shown in FIG. 5. Master carriers may be equipped to accommodate lost motion of the draw cord as described in more detail in co-pending application Ser. No. 23,071.

Rod 22 is supported on a wall or window frame by suspension brackets 26 which are connected to the top of rod 22 by means of a clasp 28 which is riveted to bracket 26 and which holds the top of rod 22 between it and a depending curved end 30 of bracket 26.

Bracket 26 is slidably connected to a base member 32 and is held in fixed relation thereto by bolt 34. Base member 32 is provided with a downward flange 36 through which it is screwed to the wall or window frame. Vertical webs 38 between base members 32 and flange 36 provide vertical support for the bracket 26. As many brackets 26 will be employed as may be needed adequately to support the curtain 10.

A pulley case 40 is provided at each end of rod 22, only one of which will be described, it being understood that the pulley cases at the respective ends are mirror images of each other. Each pulley case houses a pair of pulleys 42 on vertically disposed axes. A draw cord 44 passes over pulleys 42 from inside rod 22 and horizontally outwardly to the rear of the rod. The draw cord can exit from either end of the rod. Normally it exits only from one end, and merely reverses its direction within the pulley case at the other end. After exiting from pulley case 40, draw cord 44 passes horizontally rearwardly to a second set of pulleys 46, where it turns downwardly adjacent to the wall. Pulleys 46 are mounted on a wall pulley bracket 48 which is screwed to the wall.

A horizontal spacer 50 interconnects pulley case 40 and wall pulley bracket 48. It will be noted that neither the pulley case 40, the wall pulley bracket 48, nor the horizontal spacer 50 supports the weight of the rod. Thus, these elements need only be strong enough to accommodate the pulley requirements. In addition, since the draw cord 44 pulls horizontally rearwardly from pulley case 40, tension on the draw cord 44 adds nothing to the burden of suspension brackets 26. Vertical tension on the draw cord 44 is borne entirely by wall pulley bracket 48, and since the lever arm involved is very short (i.e. defined by the distance between the axis of pulleys 46 and the wall) the load-bearing demands on wall pulley brackets 48 is minimal.

Figure 1:
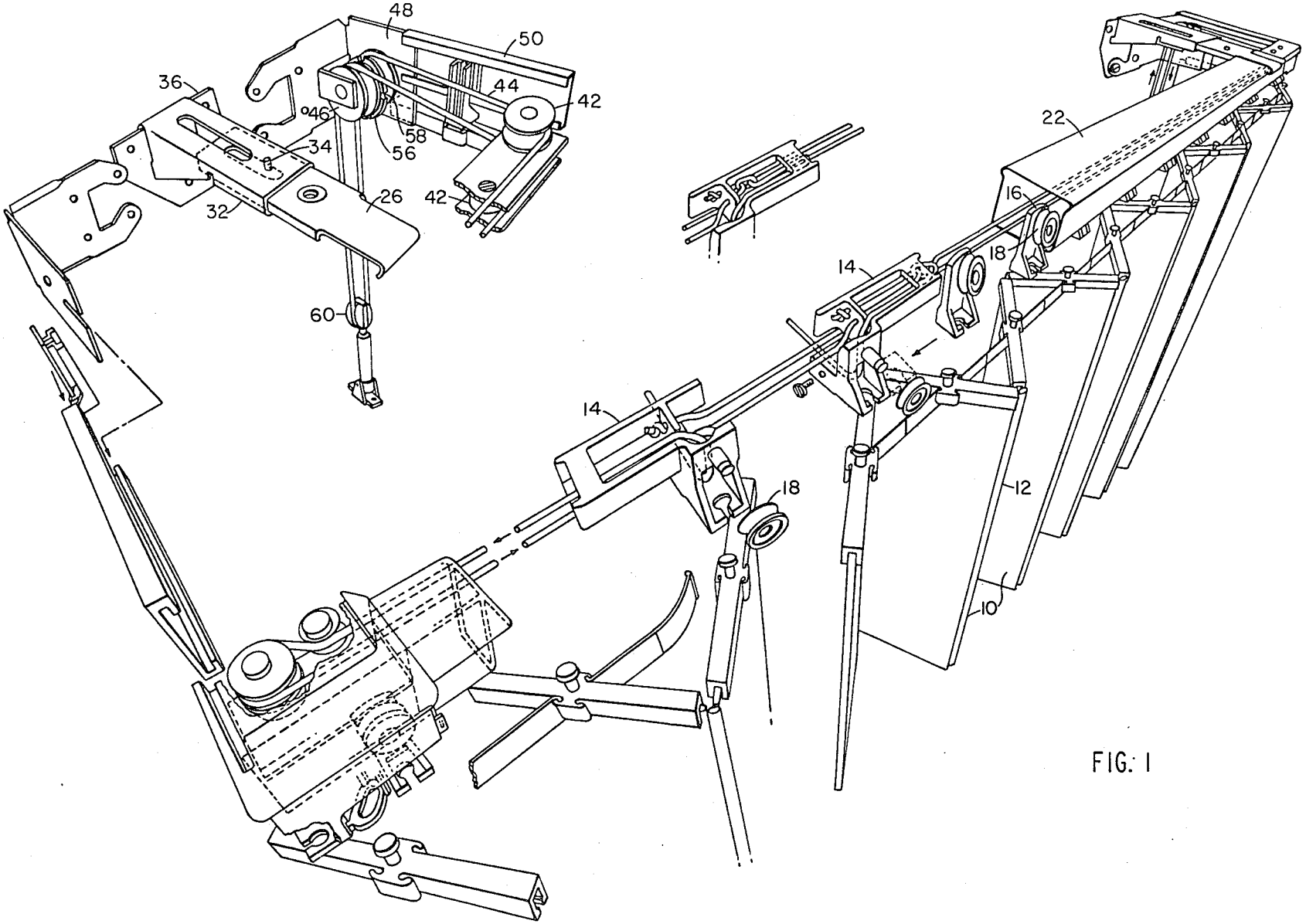
FIG. 1 is an exploded view in perspective showing the components of the invention in the context of supporting a woven wood curtain.
Figure 2:
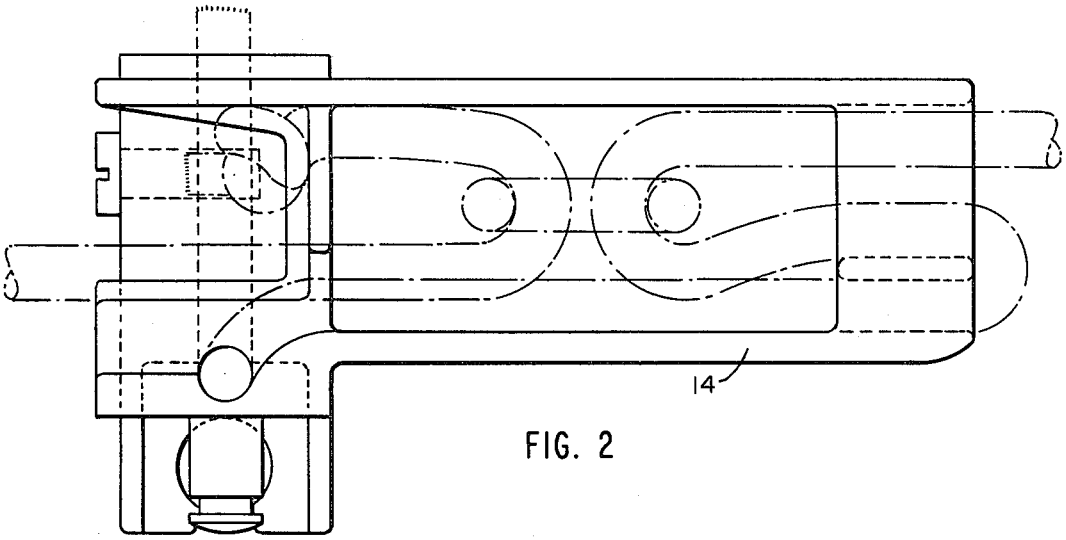
FIG. 2 is a plan view from above of a right hand master carrier employed in the invention.
Figure 3:
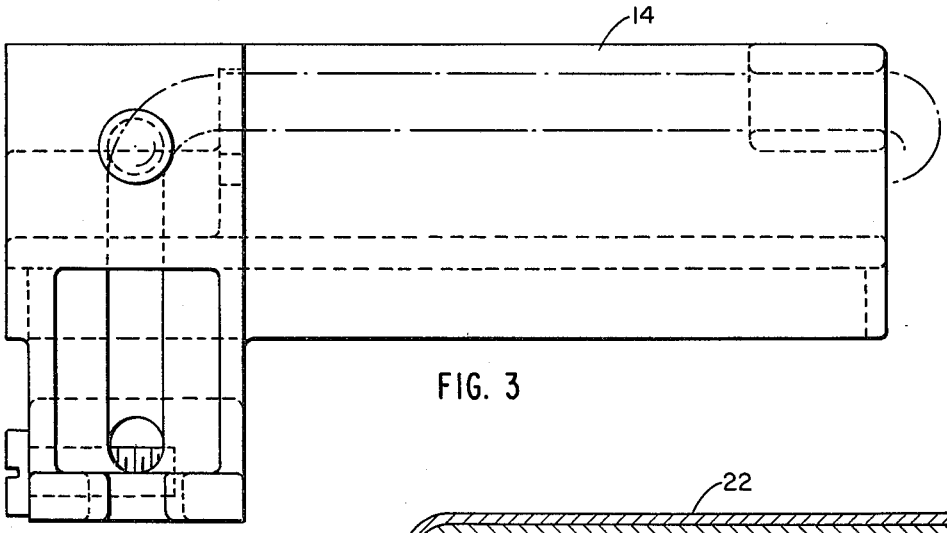
FIG. 3 is a plan view from below of a left hand master carrier.
Figure 4:
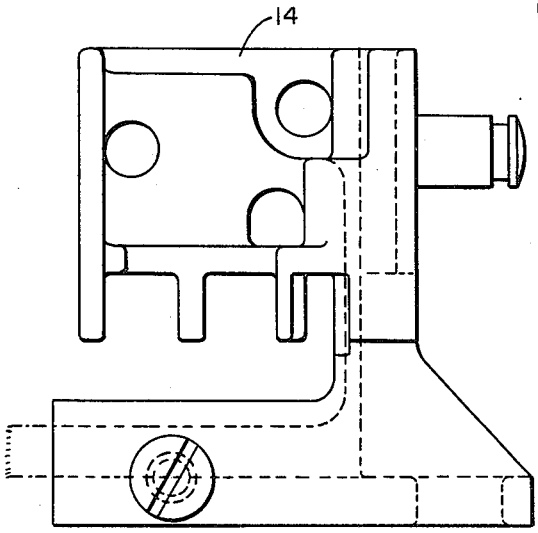
FIG. 4 is a view in end elevation from the left of the right hand master carrier of FIG. 2.
Figure 8:
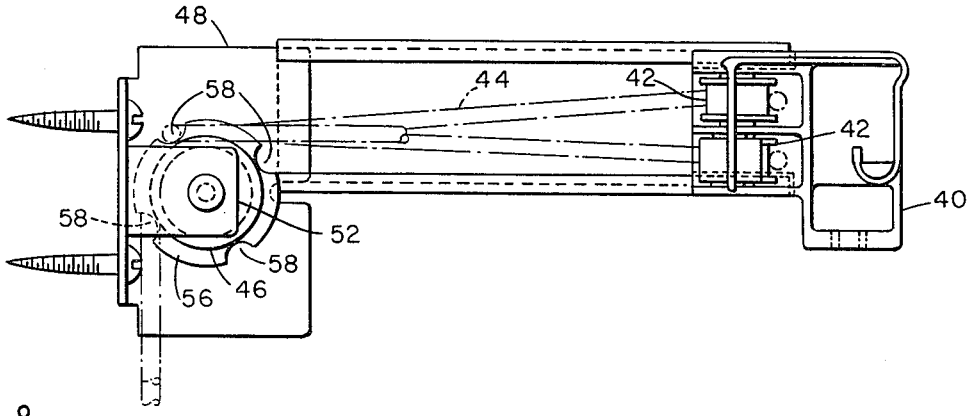
FIG. 8 is a view in end elevation of the pulley case in the rod and the wall pulley arrangement of the invention.

Pulleys 46 are mounted on a rivet between flanges 52 and 54 of bracket 48, with a rotatable separating disc 56 between the pulleys 46. The disc 56 is notched orthogonally at 58 (see FIG. 8) to permit the loop of draw cord 44 to be passed over the pulleys 46 and down to a tension pulley 60 (see FIG. 1 upper left) on the floor adjacent to the wall.

While I have shown the invention in the context of a "woven wood" curtain, it is useful also in other contexts and should not be considered limited to woven wood. In addition, various other modifications will now be apparent to those skilled in the art and therefore it is not intended to confine the invention to the precise form herein shown but rather to limit it only in terms of the appended claims.

I claim:

1. A drapery traverse rod and support combination comprising:

a traverse rod having a slot;

curtain carriers movable in said slot for supporting a curtain;

a draw cord for moving said carriers;

a pulley case at each end of said rod;

a multiplicity of suspension brackets mounted on a wall connected to said rod said brackets located intermediate of the ends of said rod and free of the path of said carriers;

said suspension brackets providing the sole support of said rod on said wall, means for leading a loop of said draw cord horizontally toward said wall, a pair of adjacent wall pulleys for receiving said loop, means for mounting said wall pulleys to rotate in mutually adjacent relation, a rotatable separating disc between said wall pulleys, and at least one notch in said disc for leading a loop of the draw cord over said wall pulleys.

* * * * *